US009306272B2

(12) United States Patent
Yoon

(10) Patent No.: US 9,306,272 B2
(45) Date of Patent: Apr. 5, 2016

(54) DEVICE FOR FIXING A SATELLITE ANTENNA FOR CONSTRUCTION EQUIPMENT

(75) Inventor: Chun-Jin Yoon, Changwon-si (KR)

(73) Assignee: VOLVO CONSTRUCTION EQUIPMENT AB (SE)

( * ) Notice: Subject to any disclaimer, the term of this patent is extended or adjusted under 35 U.S.C. 154(b) by 196 days.

(21) Appl. No.: 14/007,839

(22) PCT Filed: Apr. 22, 2011

(86) PCT No.: PCT/KR2011/002910

§ 371 (c)(1),
(2), (4) Date: Sep. 26, 2013

(87) PCT Pub. No.: WO2012/144671

PCT Pub. Date: Oct. 26, 2012

(65) Prior Publication Data

US 2014/0022129 A1 Jan. 23, 2014

(51) Int. Cl.

*H01Q 1/12* (2006.01)
*H01Q 1/32* (2006.01)
*H01Q 1/08* (2006.01)

(52) U.S. Cl.

CPC ..... *H01Q 1/3283* (2013.01); *H01Q 1/085* (2013.01); *H01Q 1/1214* (2013.01); *H01Q 1/1221* (2013.01); *H01Q 1/3258* (2013.01)

(58) Field of Classification Search

CPC ..... H01Q 1/085; H01Q 1/12; H01Q 1/20; H01Q 1/32; H01Q 1/325; H01Q 1/3283; H01Q 1/1214; H01Q 1/1221; H01Q 1/3258; H01Q 1/3266; H01Q 1/3275

USPC ..... 343/711, 713, 715, 878, 892; 83/711, 83/713, 715, 878, 892

See application file for complete search history.

(56) References Cited

U.S. PATENT DOCUMENTS 2,097,707 A * 11/1937 Tichenor ..... 343/888
2,286,439 A * 6/1942 Richter ..... 343/872

(Continued)

FOREIGN PATENT DOCUMENTS

FR 873521 A 7/1942
FR 1057209 A 3/1954

(Continued)

OTHER PUBLICATIONS

International Search Report (in Korean and English) and Written Opinion (in Korean) for PCT/KR2011/002910, mailed Dec. 22, 2011; ISA/KR.

(Continued)

*Primary Examiner* — Sue A Purvis
*Assistant Examiner* — Patrick Holecek
(74) *Attorney, Agent, or Firm* — Harness, Dickey & Pierce, P.L.C.

(57) ABSTRACT

An apparatus for fixing a satellite antenna for a construction machine is disclosed, which can adjust the height of the satellite antenna that is installed outside a cab to receive a signal of a satellite receiver installed inside the cab when the equipment is transported or operated in a workshop having a low ceiling. The apparatus for fixing a satellite antenna for a construction machine that is mounted outside a cab to receive a signal of a satellite receiver installed inside the cab, includes a bracket composed of a first mount portion mounted on an outer surface of the cab, a second mount portion formed to extend from the first mount portion to be bent, and a third mount portion formed to be bent against the second mount portion; a satellite antenna mounted on the second mount portion to receive a satellite signal; and a hanger fixing a pole, which is laid down to prevent the damage of the satellite antenna due to contact with an obstacle when the equipment is transported or operated, to the third mount portion.

4 Claims, 3 Drawing Sheets

(56) References Cited

U.S. PATENT DOCUMENTS

| | | | | |
|---|---|---|---|---|
| 2,840,199 | A | 6/1958 | Marris | |
| 3,011,818 | A * | 12/1961 | Matthiessen | 292/288 |

FOREIGN PATENT DOCUMENTS

| | | | |
|---|---|---|---|
| JP | 2003-060420 | A | 2/2003 |
| JP | 2004-304266 | A | 10/2004 |
| KR | 10-2000-0060610 | A | 10/2000 |
| KR | 10-2003-0021440 | A | 3/2003 |

OTHER PUBLICATIONS

International Preliminary Report on Patentability (Chapter II) (in Korean) for PCT/KR2011/002910, dated Apr. 3, 2013; IPEA/KR.
European Search Report for Application No. 11864048.1 dated Aug. 29, 2014.
Office Action for Chinese Patent Application No. 201180069757.0 dated Oct. 27, 2014.

* cited by examiner

PRIOR ART

DEVICE FOR FIXING A SATELLITE ANTENNA FOR CONSTRUCTION EQUIPMENT

FIELD OF THE INVENTION

The present invention relates to an apparatus for fixing a satellite antenna for a construction machine. More particularly, the present invention relates to an apparatus for fixing a satellite antenna for a construction machine, which can adjust the height of the satellite antenna that is installed outside a cab to receive a signal of a satellite receiver installed inside the cab when the construction machine is transported or operated in a workshop having a low ceiling.

BACKGROUND OF THE INVENTION

A satellite antenna for a construction machine in the related art as illustrated in FIG. 1 includes a bracket 3 that is fastened to an outer surface of the rear of a cab 1, and a satellite antenna 5 mounted on a seating portion 4 of the bracket 3 to receive a satellite signal that is to be transferred to a satellite receiver (not illustrated) installed inside the cab 1.

In the drawing, the unexplained reference numeral 6 denotes a satellite antenna cable, 7 denotes a work lamp, 8 denotes a warning lamp, and 9 denotes an operator protection structure (FOPS).

According to the satellite antenna for a construction machine in the related art, since the height of a pole of the satellite antenna is lower than the height of a working device such as a boom, communication disorders may occur, and the satellite antenna 5 may not appropriately operate to cause client dissatisfaction.

On the other hand, the height of the satellite antenna 5 that is mounted on the seating portion 4 of the bracket 3 is unable to be adjusted. Due to this, when a transport vehicle on which an excavator is mounted takes the underpass of a bridge or the excavator is operated in a workshop having a low ceiling, the satellite antenna 5, on which the pole is formed to project upward from the cab 1, may be damaged.

DETAILED DESCRIPTION OF THE INVENTION

Technical Problems

Therefore, the present invention has been made to solve the above-mentioned problems occurring in the related art, and one embodiment of the present invention is related to an apparatus for fixing a satellite antenna for a construction machine, which can lower the height of the satellite antenna to prevent the damage of the satellite antenna due to contact with an obstacle when a transport vehicle on which the construction machine is mounted takes the underpass of a bridge or the construction machine is operated in a workshop having a low ceiling.

One embodiment of the present invention is related to an apparatus for fixing a satellite antenna for a construction machine, which can elastically support the pole of the satellite antenna that is horizontally laid down to lower the height of the satellite antenna, and thus can prevent the damage of the satellite antenna due to shaking that repeatedly occurs on the construction machine.

Technical Solution

In accordance with one aspect of the present invention, there is provided an apparatus for fixing a satellite antenna for a construction machine that is mounted outside a cab to receive a signal of a satellite receiver installed inside the cab, which includes a bracket composed of a first mount portion mounted on an outer surface of the cab, a second mount portion formed to extend from the first mount portion to be bent, and a third mount portion formed to be bent against the second mount portion; the satellite antenna mounted on the second mount portion to receive a satellite signal; and a hanger fixing a pole, which is laid down to prevent damage of the satellite antenna due to contact with an obstacle when the construction machine is transported or operated, to the third mount portion.

Preferably, the hanger may be composed of a tension coil spring having one end fixed to the third mount portion and the other end supported by the pole of the laid satellite antenna for elastic support so as to prevent the damage of the satellite antenna due to shaking repeatedly generated on the construction machine.

The apparatus for fixing a satellite antenna according to the aspect of the present invention may further include a tube type cover of a rubber material covering an outer side surface of the satellite antenna so that the pole is smoothly restored to its initial state when the pole of the satellite antenna, which is laid down to lower the height of the satellite antenna, is released.

In the apparatus for fixing a satellite antenna according to the aspect of the present invention, a hook groove may be provided, which is formed on a side surface of the second mount portion of the bracket and in which the other end of the hanger, one end of which is fixed to the third mount portion, is seated.

Advantageous Effect

The apparatus for fixing a satellite antenna according to an embodiment of the present invention as configured above has the following advantages.

When the transport vehicle on which the construction machine is mounted takes the underpass of a bridge or the construction machine is operated in a workshop having a low ceiling, the height of the satellite antenna can be lowered to prevent the damage of the satellite antenna due to contact with an obstacle. Further, the satellite antenna can be horizontally laid down to lower the height of the satellite antenna, and thus the damage of the satellite antenna due to shaking that repeatedly occurs on the construction machine can be prevented.

BRIEF DESCRIPTION OF THE DRAWINGS

The above objects, other features and advantages of the present invention will become more apparent by describing the preferred embodiments thereof with reference to the accompanying drawings, in which.

DESCRIPTION OF REFERENCE NUMERALS IN THE DRAWING

Figure 1:
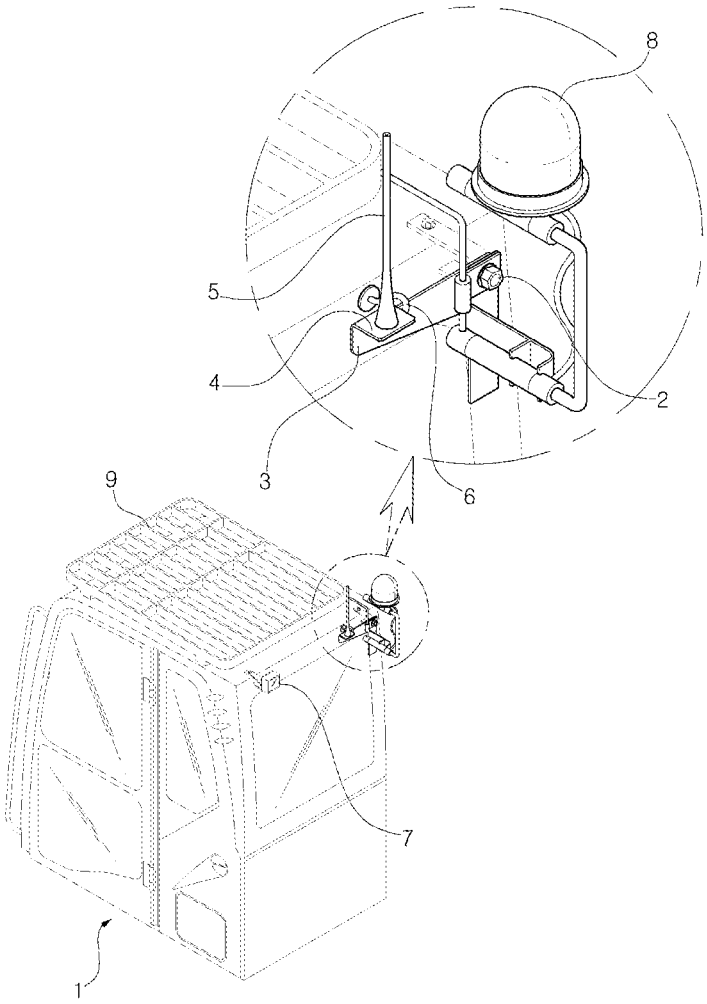
FIG. 1 is a view illustrating a use state of a satellite antenna for a construction machine in the related art.

1: cab
2: bolt
5: satellite antenna
6: satellite antenna coil
7: work lamp
8: warning lamp
9: operator protection structure
10: first mount portion
11: second mount portion
12: third mount portion
13: bracket
14: pole
15: hanger
16: cover

PREFERRED EMBODIMENTS OF THE INVENTION

Hereinafter, preferred embodiments of the present invention will be described in detail with reference to the accompanying drawings. The matters defined in the description, such as the detailed construction and elements, are nothing but specific details provided to assist those of ordinary skill in the art in a comprehensive understanding of the invention, and the present invention is not limited to the embodiments disclosed hereinafter.

Figure 2:
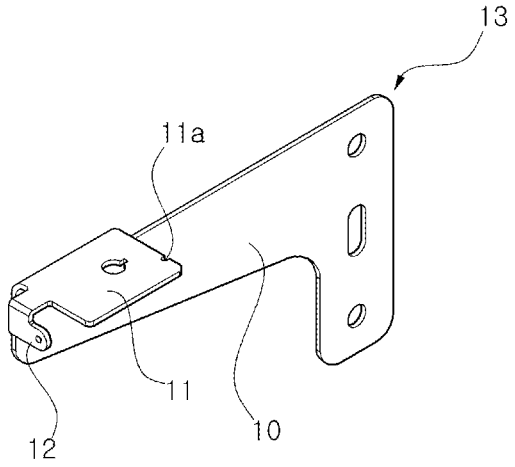
FIG. 2 is a perspective view of a bracket for mounting a satellite antenna on a cab in an apparatus for fixing the satellite antenna for a construction machine according to an embodiment of the present invention.
Figure 3:
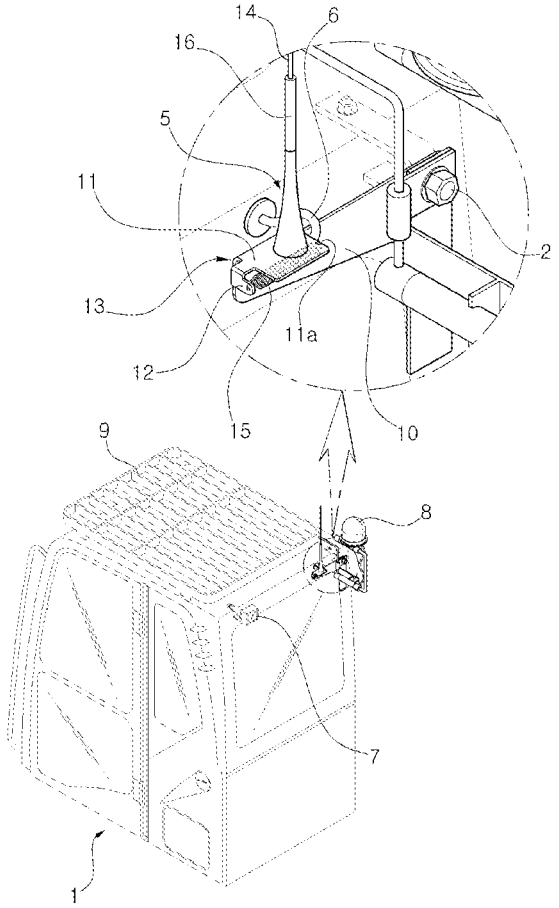
FIG. 3 is a view illustrating a first use state of an apparatus for fixing a satellite antenna for a construction machine according to an embodiment of the present invention.
Figure 4:
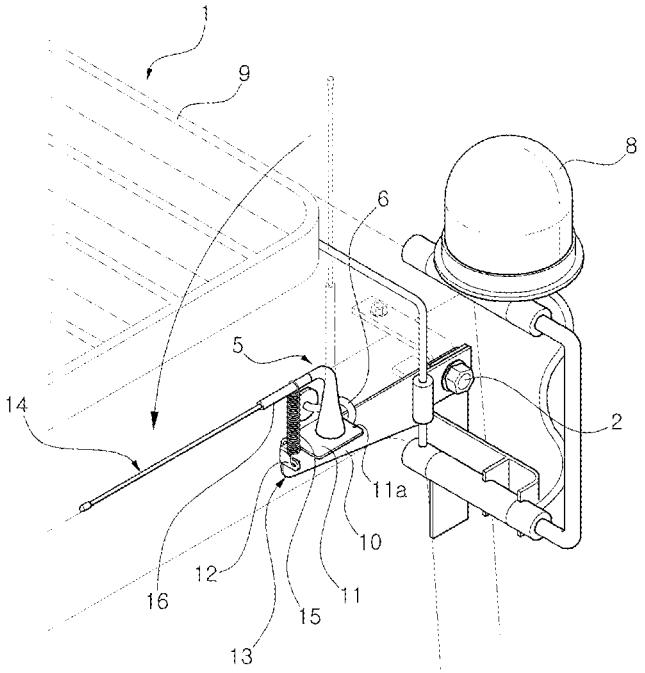
FIG. 4 is a view illustrating a second use state of an apparatus for fixing a satellite antenna for a construction machine according to an embodiment of the present invention.

As illustrated in FIGS. 2 to 4, an apparatus for fixing a satellite antenna for a construction machine that is mounted outside a cab to receive a signal of a satellite receiver installed inside the cab according to an embodiment of the present invention includes a bracket 13 composed of a first mount portion 10 mounted on an outer surface of the cab 1 by a bolt 2, a second mount portion 11 formed to extend from the first mount portion 10 to be bent, and a third mount portion 12 formed to be bent against the second mount portion 11; the satellite antenna 5 mounted on the second mount portion 11 to receive a satellite signal; and a hanger 15 fixing a pole 14, which is laid down to prevent damage of the satellite antenna 5 due to contact with an obstacle when the construction machine is transported or operated, to the third mount portion 12.

Preferably, the hanger 15 may be composed of a tension coil spring having one end fixed to the third mount portion 12 and the other end supported by the pole 14 of the laid satellite antenna 5 for elastic support so as to prevent the damage of the satellite antenna 5 due to shaking repeatedly generated on the construction machine.

The apparatus for fixing a satellite antenna according to an embodiment of the present invention may further include a tube type cover 16 of a rubber material covering an outer side surface of the satellite antenna 5 so that the pole 14 is smoothly restored to its initial state when the pole 14 of the satellite antenna 5, which is laid down to lower the height of the satellite antenna 5, is released.

In the apparatus for fixing a satellite antenna according to an embodiment of the present invention, a hook groove 11*a* may be provided, which is formed on a side surface of the second mount portion 11 of the bracket 13 and in which the other end of the hanger 15, one end of which is fixed to the third mount portion 12, is seated.

Since the configuration which includes the cab 1, the operator protection structure 9, the satellite antenna cable 6, the work lamp 7, and the warning lamp 8 that is mounted on the cab 1 by the bolt 2 for fixing the bracket 13 is the same as the configuration that is mounted on the construction machine illustrated in FIG. 1, the detailed description thereof will be omitted, and the same reference numerals are used for the same constituent elements.

Hereinafter, the use example of an apparatus for fixing a satellite antenna for a construction machine according to an embodiment of the present invention will be described with reference to the accompanying drawings.

As illustrated in FIG. 3, a satellite signal can be received through the satellite antenna 5, of which the pole 14 is fixed to the second mount portion 12 of the bracket 13 that is mounted on an outer surface of the rear of the cab 1 so that the pole 14 is directed upward during working or traveling of the construction machine.

In this case, the other end of the hanger (e.g., a tension coil spring), which has one end fixed to the third mount portion 12, is seated in the hook groove 11*a* that is formed on a side surface of the second mount portion 11. Through this, the hanger 15 can be prevented from sliding down and seceding from the second mount portion 11 due to vibrations that are generated during working.

As illustrated in FIG. 4, when the transport vehicle on which the construction machine is mounted takes the underpass of a bridge or the construction machine is operated in a workshop having a low ceiling or a narrow space, the height of the satellite antenna 5 can be lowered without using a tool to prevent the damage of the satellite antenna 5 due to contact with an obstacle.

That is, in order to lower the height of the satellite antenna 5, the pole 14 is folded and is horizontally laid down, and the other end of the hanger 15, of which one end is fixed to the second mount portion 12 of the bracket 13, is put on the outer surface of the pole 14.

At this time, since a tensile force is applied to the hanger 15, the hanger 15 elastically supports the pole 14 of the laid satellite antenna 5. Through this, the hanger 15 absorbs vibrations that repeatedly occur on the construction machine during working, and thus the damage of the satellite antenna 5 due to impact or the like can be prevented.

On the other hand, if the work using the construction machine in an underground work area is completed after the pole 14 of the satellite antenna 5 is horizontally laid down to lower the height of the satellite antenna 5, the hanger 15 may be released (the hanger 15, which elastically supports the pole 14 that is horizontally laid down, is made to secede from the pole 14, and the pole 14 stands in an upward direction as shown in FIG. 3). In this case, the pole 14 can smoothly return to its initial position by the elastic restoring force of the tube type cover 16 of a rubber material that covers the outer surface of the pole 14.

INDUSTRIAL APPLICABILITY

As apparent from the above description, according to the apparatus for fixing a satellite antenna for a construction machine according to embodiments of the present invention, when the transport vehicle on which the construction machine is mounted takes the underpass of a bridge or the construction machine is operated in a workshop having a low ceiling, the satellite antenna is horizontally laid down to lower the height of the satellite antenna, and thus the damage of the satellite antenna due to the contact with an obstacle can be prevented. Further, the pole of the satellite antenna that is horizontally laid down is elastically supported, and thus the damage of the satellite antenna due to shaking that repeatedly occurs on the construction machine can be prevented.

The invention claimed is:

1. An apparatus for fixing a satellite antenna for a construction machine that is mounted outside a cab to receive a signal of a satellite receiver installed inside the cab, comprising:

a bracket mounted to the cab and including a first mount portion mounted on an outer surface of the cab, a second mount portion formed to extend from the first mount portion to be bent, and a third mount portion formed to be bent against the second mount portion, the bracket mounting a warning lamp to the cab;

a satellite antenna mounted on the second mount portion to receive a satellite signal, the satellite antenna including a pole; and a hanger including a tension coil spring movable between an antenna fixing position and a storage position, in the antenna fixing position a first end of the tension coil spring is coupled to the third mount portion and a second end of the tension coil spring is coupled to the pole of the satellite antenna to retain the pole in an elastically laid down position away from the warning lamp to prevent the satellite antenna from shaking and contacting the warning lamp when the machine is being transported or operated;

a hook groove defined by a side surface of the second mount portion of the bracket, in the storage position of the hanger the second end of the tension coil spring is seated in the hook groove to prevent the hanger from sliding down and seceding from the second mount portion due to vibrations generated during working of the construction machine.

2. The apparatus for fixing a satellite antenna for a construction machine according to claim 1, further comprising a tube type cover of a rubber material covering an outer side surface of the satellite antenna so that the pole is smoothly restored to its initial state when the pole of the satellite antenna, which is laid down to lower the height, is released.

3. An apparatus for fixing a satellite antenna for a construction machine that is mounted on an outside of a cab to receive a signal of a satellite receiver installed within the cab, comprising:

a bracket mounted to an outer surface of the cab, the bracket including a first mount portion mounted on the outer surface of the cab, a second mount portion extending directly from the first mount portion at an angle and defining a groove, and a third mount portion extending from an end of the second mount portion opposite to the groove at an angle relative to the second mount portion;

a warning lamp mounted to the bracket to support the warning lamp at the exterior of the cab;

a satellite antenna configured to receive a satellite signal, the satellite antenna mounted to the second mount portion and including a pole configured to be bent downward from an upright active position to a laid down position; and a tension coil spring movable between an antenna fixing position and a storage position, the tension coil spring including a first end coupled to the third mount portion and a second end opposite to the first end;

wherein:

in the storage position, the second end of the tension coil spring is seated within, and coupled to, the groove of the second mount portion to prevent the tension coil spring from sliding down and seceding from the second mount portion due to vibrations generated during working of the construction machine; and in the antenna fixing position, the second end of the tension coil spring is coupled to the pole of the satellite antenna to retain the pole in the laid down position in which the pole is bent downward in an elastically laid down position away from the warning lamp to prevent the satellite antenna from shaking and contacting the warning lamp when the machine is being transported or operated.

4. The apparatus of claim 3, wherein the satellite antenna further comprises a rubber cover surrounding the pole, the rubber cover configured to return the pole to the upright active position from the laid down position after the second end of the tension coil spring is decoupled from the pole.

* * * * *